US011371303B2

(12) United States Patent
Wai et al.

(10) Patent No.: US 11,371,303 B2
(45) Date of Patent: Jun. 28, 2022

(54) DOWNHOLE TRACTOR WITH BI-DIRECTIONAL WHEEL ASSEMBLY

(71) Applicant: Halliburton Energy Services, Inc., Houston, TX (US)

(72) Inventors: Simon Whye Kwong Wai, Singapore (SG); Irvin How Jiun Yuen, Singapore (SG)

(73) Assignee: Halliburton Energy Services, Inc., Houston, TX (US)

( * ) Notice: Subject to any disclaimer, the term of this patent is extended or adjusted under 35 U.S.C. 154(b) by 300 days.

(21) Appl. No.: 16/613,067

(22) PCT Filed: Feb. 1, 2019

(86) PCT No.: PCT/US2019/016423
§ 371 (c)(1),
(2) Date: Nov. 12, 2019

(87) PCT Pub. No.: WO2020/159552
PCT Pub. Date: Aug. 6, 2020

(65) Prior Publication Data
US 2021/0355774 A1 Nov. 18, 2021

(51) Int. Cl.
*E21B 23/00* (2006.01)

(52) U.S. Cl.
CPC ..... *E21B 23/001* (2020.05)

(58) Field of Classification Search
CPC ..... E21B 23/001
See application file for complete search history.

(56) References Cited

U.S. PATENT DOCUMENTS

| | | | | |
|---|---|---|---|---|
| 9,157,287 | B2 | 10/2015 | Slocum et al. | |
| 2005/0072577 | A1* | 4/2005 | Freeman | E21B 34/14 166/386 |
| 2010/0012315 | A1* | 1/2010 | McInally | E21B 23/14 166/241.5 |
| 2014/0014323 | A1* | 1/2014 | Hallundbaek | E21B 23/14 166/243 |
| 2014/0116729 | A1 | 5/2014 | Al-Mulhem | |
| 2014/0174760 | A1 | 6/2014 | Slocum et al. | |

FOREIGN PATENT DOCUMENTS

| | | | |
|---|---|---|---|
| EP | 2505767 | A1 | 10/2012 |
| EP | 3205813 | A1 | 8/2017 |
| WO | 2008111844 | A1 | 9/2008 |

OTHER PUBLICATIONS

"Serrate, adj." OED Online. Oxford University Press, Sep. 2021. Web. Oct. 30, 2021. https://www.oed.com/view/Entry/176605 (Year: 2021).*

International Search Report & Written Opinion in International Application No. PCT/US2019/016423, dated Nov. 5, 2019.

* cited by examiner

*Primary Examiner* — David Carroll
(74) *Attorney, Agent, or Firm* — McGuireWoods LLP

(57) ABSTRACT

A downhole tractor for operational use in well casing of a wellbore. The tractor comprising a tractor body, at least one actuator assembly, and at least one tractor wheel. The actuator assembly is actionable to shift the axis of rotation of the tractor wheel. The at least one tractor wheel includes at least one bifurcated tract having a leading and trailing edge for engaging the well casing. The at least one actuator assembly causes the at least one tractor wheel to switch from traversing a first vertical plane of the well casing to a second vertical plane of the well casing when actuated.

20 Claims, 4 Drawing Sheets

DOWNHOLE TRACTOR WITH BI-DIRECTIONAL WHEEL ASSEMBLY

TECHNICAL FIELD OF THE DISCLOSURE

The present disclosure relates, in general, to downhole tractors used in wellbores and, in particular, to downhole tractors and tractor wheels.

BACKGROUND

In wellbores that include horizontal sections and horizontal landing sections, logging tools, perforating devices, bridge plugs, and other well interventions tools need to be connected to a downhole tractor so that the tool or device can be transported to where it is needed on the landing section. The range of a tractor is determined by its ability to provide sufficient traction between the wheels and casing/tubing within the wellbore. The higher the traction, the longer the range will be.

BRIEF DESCRIPTION OF THE DRAWINGS

For a more complete understanding of the features and advantages of the present disclosure, reference is now made to the detailed description along with the accompanying figures in which corresponding numerals in the different figures refer to corresponding parts and in which.

DETAILED DESCRIPTION

While the making and using of various embodiments of the present disclosure are discussed in detail below, it should be appreciated that the present disclosure provides many applicable inventive concepts, which can be embodied in a wide variety of specific contexts. The specific embodiments discussed herein are merely illustrative and do not delimit the scope of the present disclosure. In the interest of clarity, not all features of an actual implementation may be described in the present disclosure. It will of course be appreciated that in the development of any such actual embodiment, numerous implementation-specific decisions must be made to achieve the developer's specific goals, such as compliance with system-related and business-related constraints, which will vary from one implementation to another. Moreover, it will be appreciated that such a development effort might be complex and time-consuming but would be a routine undertaking for those of ordinary skill in the art having the benefit of this disclosure.

Traditional tractor wheels used in downhole tractors are fixed to the frame of the tractor and are unidirectional. The tread of the tractor wheels can become overly worn with this static configuration causing the tractor to lose traction. This can significantly limit the range of the downhole tractor. Typically, the wheels are fresh and sharp at the beginning of the conveyance and provide ample traction. As the tractor moves further downhole, the wheels experience more wear and the available traction drops.

The systems, devices, and methods presented herein maintain traction of downhole tractors so as to achieve a longer tractoring distance when used for running tools or devices downhole into a wellbore. These systems, devices, and methods describe a tractor wheel having a wheel tooth geometry which enhances traction with casing wall in both rotational directions to propel the tractor forward. The directionality of the tractor wheels is complemented by the actuation direction of an actuator or actuators that control the position of the tractors wheels. The tractor wheels can first rotate in one direction until the traction is low. After which, the rotation of the wheels is changed so that traction can be improved. By harnessing the traction of the wheel in both directions, the range of the tractor is greatly enhanced. The range of the downhole tractor can be doubled, which doubles the tractoring distance of any existing tractors. Double acting hydraulic actuator or actuators are used in the tractor allowing actuator arms to extend in both directions of the tractor. The reciprocating motion of the actuator can also be achieved by other means such as a ballscrew, leadscrew and rack and pinion.

Figure 1:
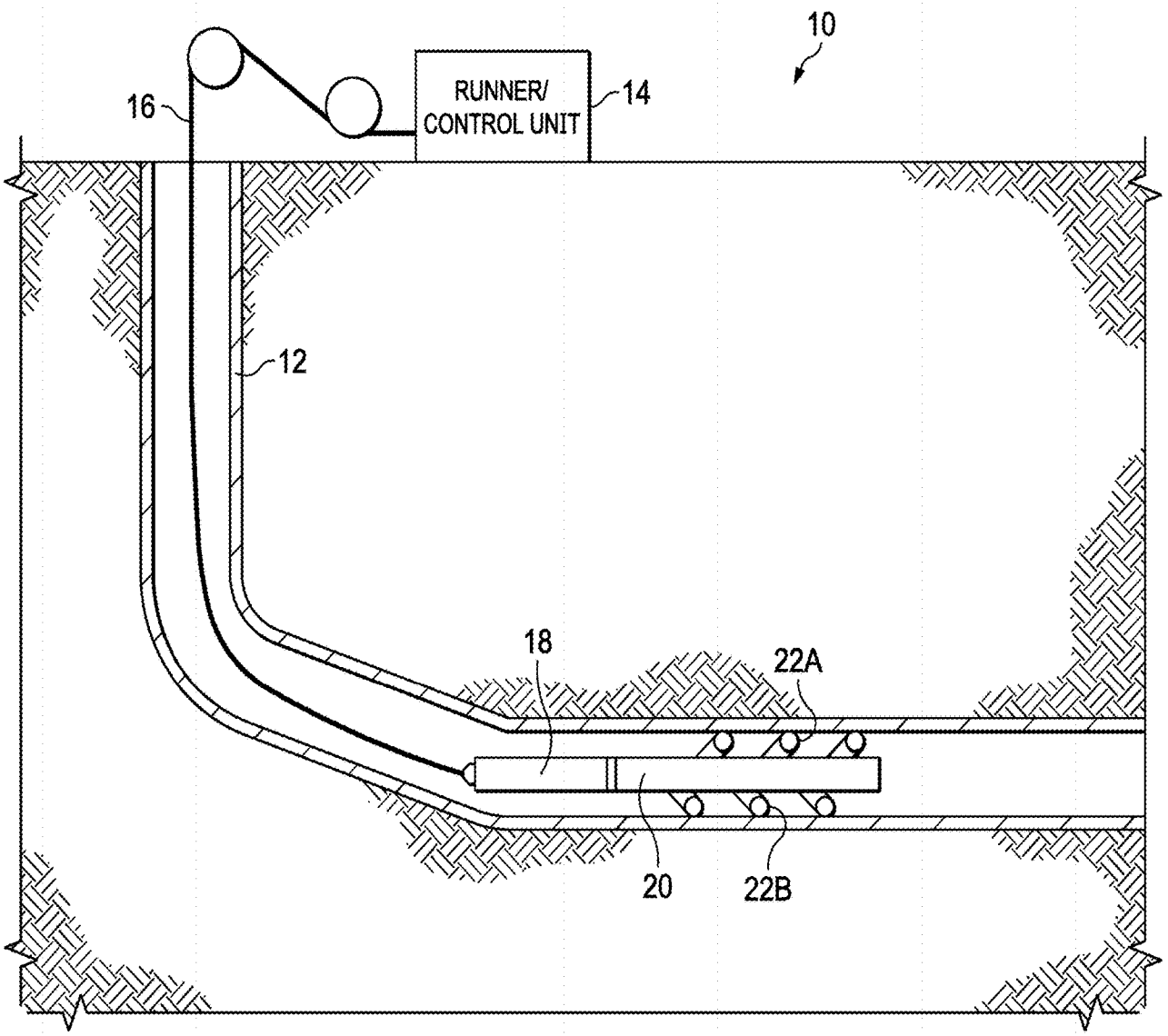
FIG. 1 is an illustration of a wellsite and control system utilizing a downhole tractor for well site intervention, in accordance with certain example embodiments.

Referring to FIG. 1, illustrated is a well site utilizing a downhole tractor for well site intervention, in accordance with certain embodiments, denoted generally as 10. The well site 10 includes well casing 12 within a wellbore within a formation, a runner and control unit 14, runner string 16, a runner tool 18 for well intervention, and adjustable tractor wheels 22A and 22B. The downhole tractor 20 includes a first and second set of adjustable tractor wheels 22A and 22B. The tractor wheels 22A and 22B engage with the casing 12 and have a tread that improves so that the tractor 20 can more effectively traverse the casing 12 when tractoring non-vertically. Over time, the tread of the tractor wheels 22A and 22B wears down enough that the tractor 20 either stalls completely or slows significantly. The tractor wheels 22A, 22B can be switched at this point so that the wheels track in different directions. The runner and control unit 14 can trigger the wheels to track in different directions.

Figure 2A:
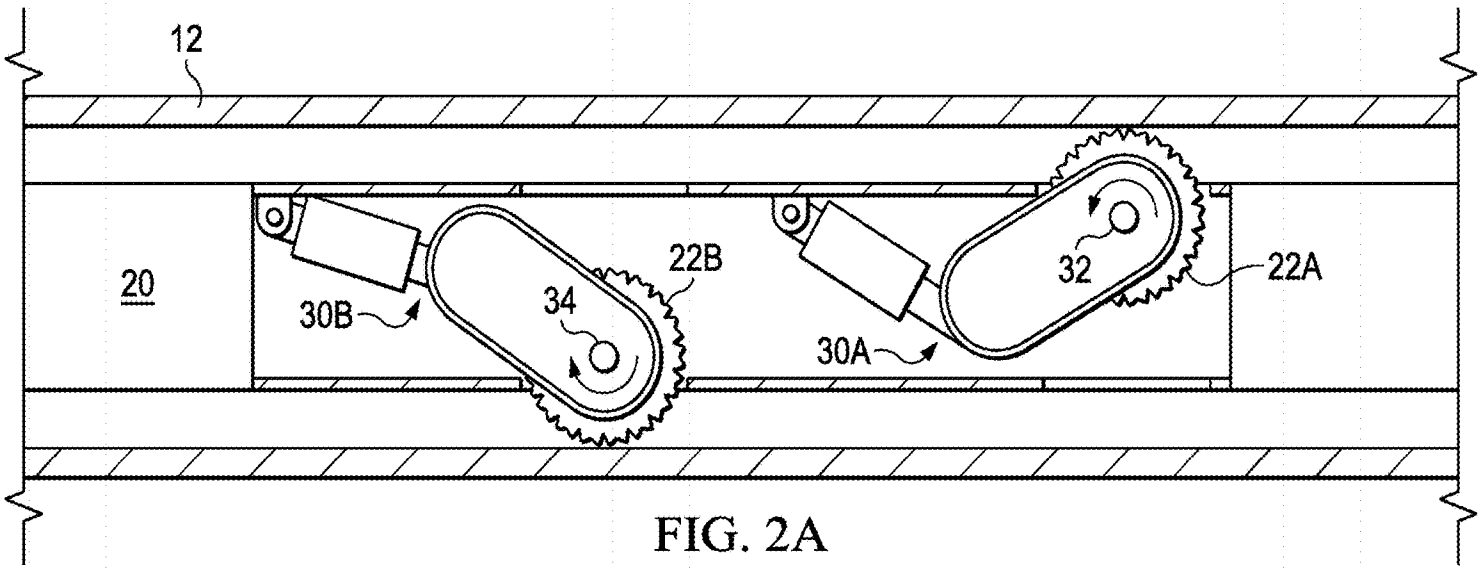
FIGS. 2A and 2B are illustrations of tractor wheels and actuator assemblies of the downhole tractor, in accordance with certain example embodiments.
Figure 2B:
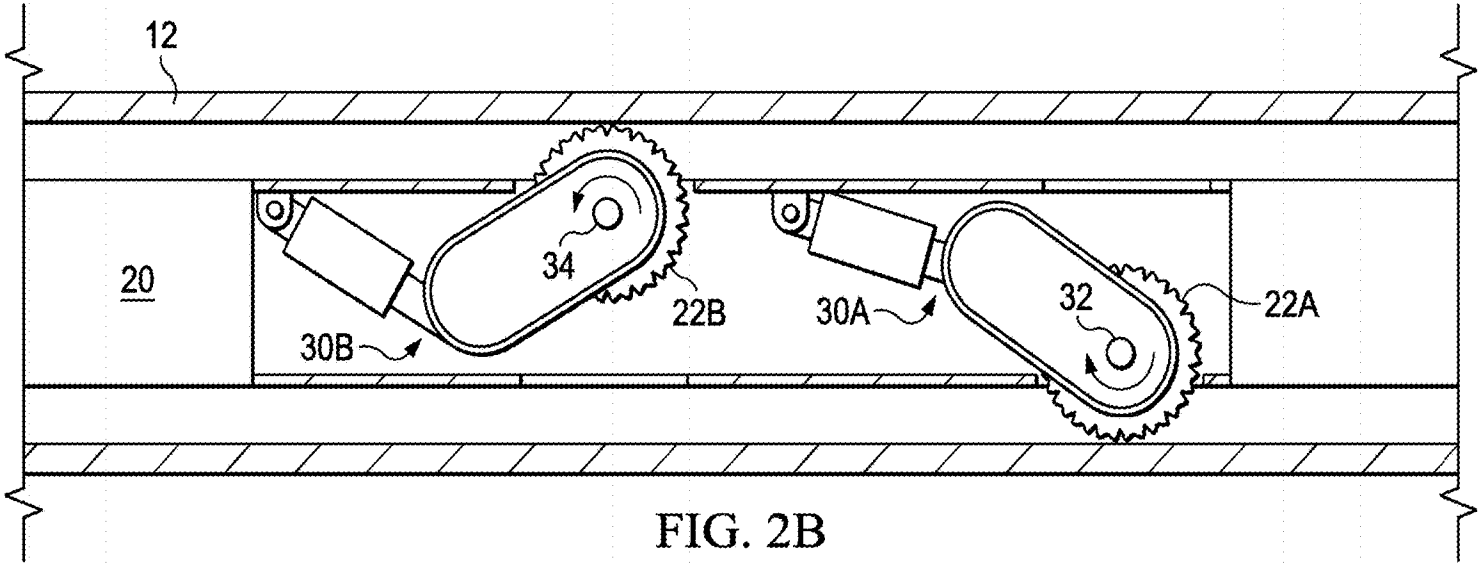

Referring now to FIG. 2, illustrated are tractor wheel 22A and 22B and actuator assemblies 30A, 30B, in accordance with certain example embodiments. Assemblies 30A, 30B can include actuators and actuator arms coupled to the tractor wheels 22A and 22B. Although, it should be understood that the actuators can be coupled directed to the tractor wheels 38, 40. It should also be understood that each actuator assembly 30A, 30B can be coupled to multiple tractor wheels. So, attached to assembly 30A, 30B can be multiple tractors wheels 22A, 22B aligned in series along an axle 32, 34 of the assembly 30A, 30B. The reciprocation of the tractor wheels can be responsive to any type of actuator, e.g. hydraulic, pneumatic, or electric. The actuators 30, 32 can be activated by the runner control unit 14 either through power and control lines ran with the running string 16 or wirelessly. It should also be understood that the wheels can be coupled directly to the actuators. In addition, the actual number of tractor wheels 22A, 22B per downhole tractor 20 can vary depending on requirements. It should also be understood that one actuator can be used to move multiple wheels.

Figure 3:
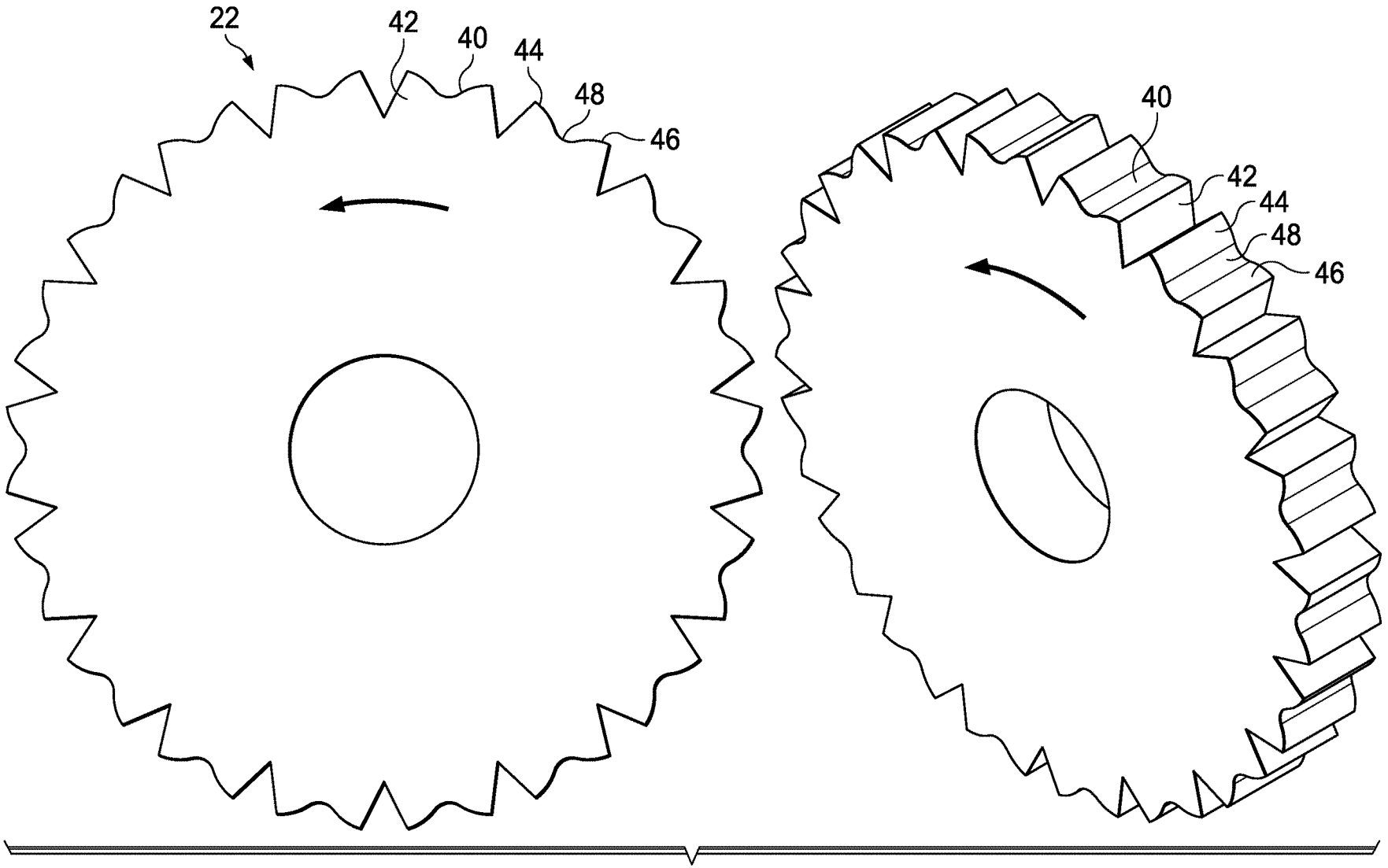
FIG. 3 is an illustration of a tractor wheel and wheel tread geometry, in accordance with certain example embodiments.
Figure 4A:
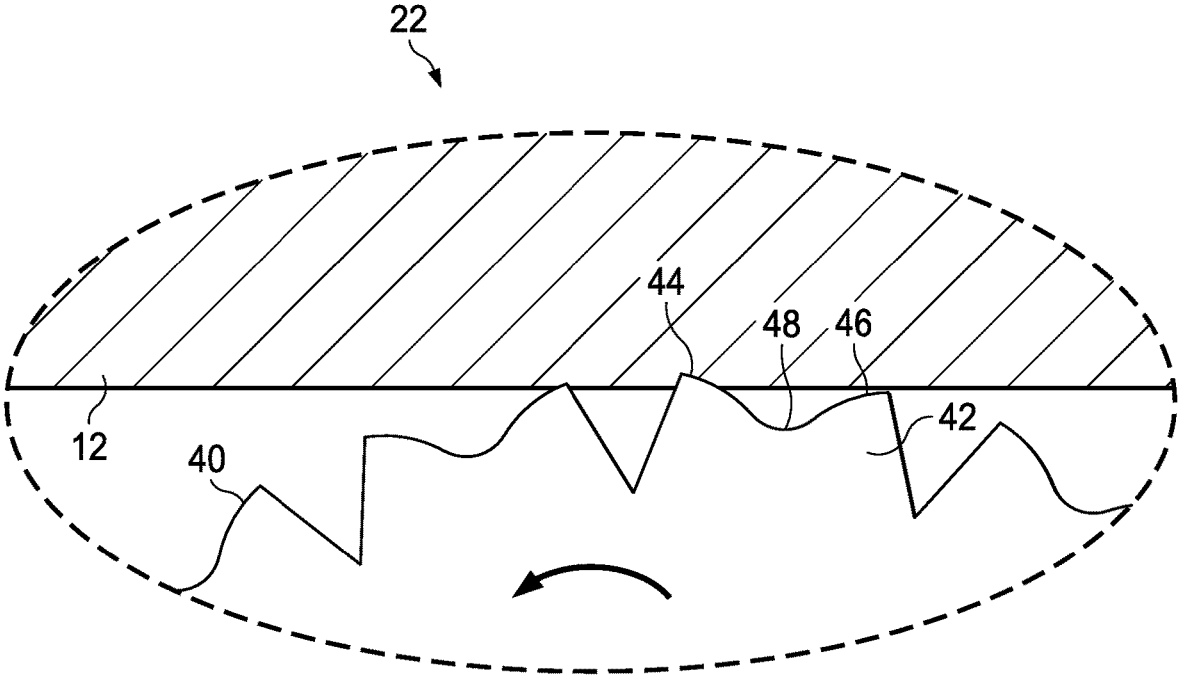
FIGS. 4A and 4B is an illustration of the wheel tread geometry of the tractor wheel, in accordance with certain example embodiments.
Figure 4B:
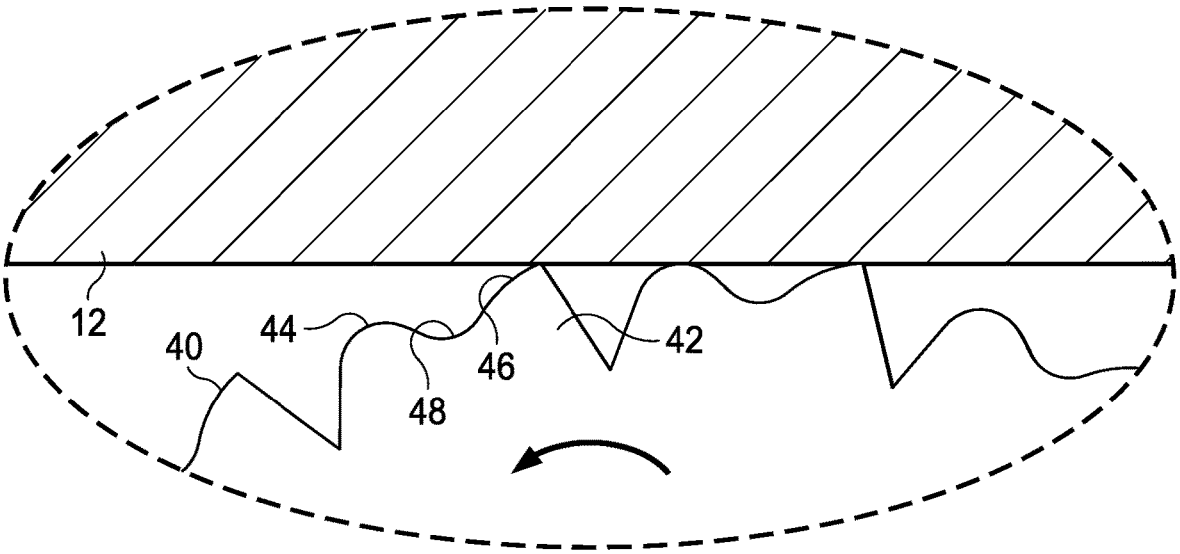

Referring now to FIG. 3, illustrated is tractor wheel 22, in accordance with certain example embodiments. Tractor wheel 22 includes a geometry that improves the traction of the downhole tractor 20. The geometry includes a tread 40 disposed on a tooth 42 that has a saw like or bifurcated tracks. The tread 40 is the outer radial surface of the tooth 42 and comprises a leading edge 44, trailing edge 46, and a dip 48 separating the leading edge 44 and trailing edge 46. The tread 40 includes sharp edges that can either be the leading 44 or trailing 46 edge depending on the wheel's position in the downhole tractor 20. After enough wear, the wheel 22 will begin to slip and the actuator 30 can be actuated so that the leading edge 44 becomes the trailing edge 46 and the trailing edge 46 becomes the leading edge 44. As illustrated in FIG. 4A, the tread 40 includes a sharp leading edge 44 that over time can become dull, see FIG. 4B, and, therefore, less effective in getting the traction needed to effectively move the tractor 20. Once the tractor 20 begins to slip, the actuators 30 can be actuated to change the position of the wheels 22 and, therefore, the rotation of the wheels 22. The wheels are typically made out of metals with high yield strength and high toughness. The tread of the teeth 42 on the wheels can be surface hardened to improve wear resistant and prolong the life of the wheel.

The example systems, methods, and acts described in the embodiments presented previously are illustrative, and, in alternative embodiments, certain acts can be performed in a different order, in parallel with one another, omitted entirely, and/or combined between different example embodiments, and/or certain additional acts can be performed, without departing from the scope and spirit of various embodiments. Accordingly, such alternative embodiments are included in the description herein.

As used herein, the singular forms "a", "an" and "the" are intended to include the plural forms as well, unless the context clearly indicates otherwise. It will be further understood that the terms "comprises" and/or "comprising," when used in this specification, specify the presence of stated features, integers, steps, operations, elements, and/or components, but do not preclude the presence or addition of one or more other features, integers, steps, operations, elements, components, and/or groups thereof. As used herein, the term "and/or" includes any and all combinations of one or more of the associated listed items. As used herein, phrases such as "between X and Y" and "between about X and Y" should be interpreted to include X and Y. As used herein, phrases such as "between about X and Y" mean "between about X and about Y." As used herein, phrases such as "from about X to Y" mean "from about X to about Y."

The above-disclosed embodiments have been presented for purposes of illustration and to enable one of ordinary skill in the art to practice the disclosure, but the disclosure is not intended to be exhaustive or limited to the forms disclosed. Many insubstantial modifications and variations will be apparent to those of ordinary skill in the art without departing from the scope and spirit of the disclosure. The scope of the claims is intended to broadly cover the disclosed embodiments and any such modification. Further, the following clauses represent additional embodiments of the disclosure and should be considered within the scope of the disclosure:

Clause 1, a downhole tractor for operational use in well casing of a wellbore, the tractor comprising: a tractor body for tracking the well casing comprising: at least one actuator assembly actionable coupled to the tractor body; and at least one tractor wheel coupled to the at least one actuator assembly; wherein the actuator assembly is actionable to shift the axis of rotation of the tractor wheel;

Clause 2, the downhole tractor of claim 1 wherein there is at least one tractor wheel per actuator assembly;

Clause 3, the downhole tractor of clause 1 wherein the at least one tractor wheel includes at least one serrated track for engaging the well casing;

Clause 4, the downhole tractor of clause 1 wherein the at least one tractor wheel includes at least one bifurcated tract having a leading and trailing edge for engaging the well casing;

Clause 5, the downhole tractor of clause 1 wherein the at least one actuator assembly causes the at least one tractor wheel to switch from traversing a first vertical plane of the well casing to a second vertical plane of the well casing when actuated;

Clause 6, the downhole tractor of clause 1 wherein the at least one actuator assembly in response to a first action causes the at least one tractor wheel to switch from traversing a first vertical plan of the well casing to a second vertical plane of the well casing and in response to a second action causes the at least one tractor wheel to switch from traversing the second vertical plane of the well casing to the first vertical plane;

Clause 7, the downhole tractor of clause 1 further comprising: a plurality of tractor wheels with at least one tractor wheel of the plurality is associated with a first group and at least one other tractor wheel is associated with a second group; wherein the at least one actuator assembly causes the first group to switch from traversing a first vertical plane of the well casing to a second vertical plane of the well casing when actuated and the second group from traversing the second vertical plane of the well casing when actuated;

Clause 8, the downhole tractor of clause 7 wherein the actuator assembly causes the switch simultaneously.

Clause 9, the downhole tractor of clause 1 further comprising: a plurality of tractor wheels; wherein the at least one actuator assembly causes the plurality of tractor wheels to switch from traversing a first vertical plane of the well casing to a second vertical plane of the well casing when actuated;

Clause 10, a method of operating a downhole tractor in a well casing of a wellbore, the method comprising: placing the tractor in the well casing; and driving the tractor down the well casing; wherein the tractor comprises: a tractor body for tracking the well casing comprising: at least one actuator assembly actionable coupled to the tractor body; and at least one tractor wheel coupled to the at least one actuator assembly; wherein the actuator assembly is actionable to shift the axis of rotation of the tractor wheel;

Clause 11, the method of clause 10 wherein there is at least one tractor wheel per actuator assembly;

Clause 12, the method of clause 10 wherein the at least one tractor wheel includes at least one serrated track for engaging the well casing;

Clause 13, the method of clause 10 wherein the at least one tractor wheel includes at least one bifurcated tract having a leading and trailing edge for engaging the well casing;

Clause 14, the method of clause 10 wherein the at least one actuator assembly causes the at least one tractor wheel to switch from traversing a first vertical plane of the well casing to a second vertical plane of the well casing when actuated;

Clause 15, the method of clause 10 wherein the at least one actuator assembly in response to a first action causes the at least one tractor wheel to switch from traversing a first vertical plan of the well casing to a second vertical plane of the well casing and in response to a second action causes the at least one tractor wheel to switch from traversing the second vertical plane of the well casing to the first vertical plane;

Clause 16, the method of clause 10 further comprising: a plurality of tractor wheels with at least one tractor wheel of the plurality is associated with a first group and at least one other tractor wheel is associated with a second group; wherein the at least one actuator assembly causes the first group to switch from traversing a first vertical plane of the well casing to a second vertical plane of the well casing when actuated and the second group from traversing the second vertical plane of the well casing;

Clause 17, the method of clause 16 wherein the actuator assembly causes the switch simultaneously;

Clause 18, the method of clause 10 further comprising: a plurality of tractor wheels; wherein the at least one actuator assembly causes the plurality of tractor wheels to switch from traversing a first vertical plane of the well casing to a second vertical plane of the well casing when actuated; and Clause 19, a tractor wheel assembly for operational use in well casing of a wellbore, the tractor wheel assembly comprising: at least one actuator assembly actionable coupleable to a tractor body; and at least one tractor wheel coupled to the at least one actuator assembly; wherein the actuator assembly is actionable to shift the axis of rotation of the tractor wheel;

Clause 20, the tractor wheel assembly of clause 19 wherein the at least one tractor wheel includes treads for engaging the well casing.

The foregoing description of embodiments of the disclosure has been presented for purposes of illustration and description. It is not intended to be exhaustive or to limit the disclosure to the precise form disclosed, and modifications and variations are possible in light of the above teachings or may be acquired from practice of the disclosure. The embodiments were chosen and described in order to explain the principals of the disclosure and its practical application to enable one skilled in the art to utilize the disclosure in various embodiments and with various modifications as are suited to the particular use contemplated. Other substitutions, modifications, changes and omissions may be made in the design, operating conditions and arrangement of the embodiments without departing from the scope of the present disclosure. Such modifications and combinations of the illustrative embodiments as well as other embodiments will be apparent to persons skilled in the art upon reference to the description. It is, therefore, intended that the appended claims encompass any such modifications or embodiments.

What is claimed is:

1. A downhole tractor for operational use in well casing of a wellbore, the tractor comprising:

a tractor body for tracking the well casing comprising:

at least one actuator assembly actionable coupled to the tractor body; and at least one tractor wheel coupled to the at least one actuator assembly; wherein the at least one tractor wheel includes at least one bifurcated tract having a tooth comprising a leading and trailing edge for engaging the well casing; wherein the leading edge and trailing edge are separated by a dip; wherein the leading edge makes first contact with an adjacent surface in a first direction of wheel rotation; wherein the trailing edge makes first contact with an adjacent surface in a second direction of wheel rotation;

wherein the actuator assembly is actionable to shift the axis of rotation of the tractor wheel.

2. The downhole tractor of claim 1 wherein there is at least one tractor wheel per actuator assembly.

3. The downhole tractor of claim 1 wherein the at least one actuator assembly causes the at least one tractor wheel to switch from traversing a first vertical plane of the well casing to a second vertical plane of the well casing when actuated.

4. The downhole tractor of claim 1 wherein the at least one actuator assembly in response to a first action causes the at least one tractor wheel to switch from traversing a first vertical plan of the well casing to a second vertical plane of the well casing and in response to a second action causes the at least one tractor wheel to switch from traversing the second vertical plane of the well casing to the first vertical plane.

5. The downhole tractor of claim 1 further comprising:

a plurality of tractor wheels with at least one tractor wheel of the plurality is associated with a first group and at least one other tractor wheel is associated with a second group;

wherein the at least one actuator assembly causes the first group to switch from traversing a first vertical plane of the well casing to a second vertical plane of the well casing when actuated and the second group from traversing the second vertical plane of the well casing when actuated.

6. The downhole tractor of claim 5 wherein the actuator assembly causes the switch simultaneously.

7. The downhole tractor of claim 1 further comprising:

a plurality of tractor wheels;

wherein the at least one actuator assembly causes the plurality of tractor wheels to switch from traversing a first vertical plane of the well casing to a second vertical plane of the well casing when actuated.

8. A method of operating a downhole tractor in a well casing of a wellbore, the method comprising:

placing the tractor in the well casing; and driving the tractor down the well casing;

wherein the tractor comprises:

a tractor body for tracking the well casing comprising:

at least one actuator assembly actionable coupled to the tractor body; and at least one tractor wheel coupled to the at least one actuator assembly; wherein the at least one tractor wheel includes at least one bifurcated tract having a tooth comprising a leading and trailing edge for engaging the well casing; wherein the leading edge and trailing edge are separated by a dip; wherein the leading edge makes first contact with an adjacent surface in a first direction of wheel rotation; wherein the trailing edge makes first contact with an adjacent surface in a second direction of wheel rotation;

wherein the actuator assembly is actionable to shift the axis of rotation of the tractor wheel.

9. The method of claim 8 wherein there is at least one tractor wheel per actuator assembly.

10. The method of claim 8 wherein the at least one actuator assembly causes the at least one tractor wheel to switch from traversing a first vertical plane of the well casing to a second vertical plane of the well casing when actuated.

11. The method of claim 8 wherein the at least one actuator assembly in response to a first action causes the at least one tractor wheel to switch from traversing a first vertical plan of the well casing to a second vertical plane of the well casing and in response to a second action causes the at least one tractor wheel to switch from traversing the second vertical plane of the well casing to the first vertical plane.

12. The method of claim 8 further comprising:

a plurality of tractor wheels with at least one tractor wheel of the plurality is associated with a first group and at least one other tractor wheel is associated with a second group;

wherein the at least one actuator assembly causes the first group to switch from traversing a first vertical plane of the well casing to a second vertical plane of the well casing when actuated and the second group from traversing the second vertical plane of the well casing.

13. The method of claim 12 wherein the actuator assembly causes the switch simultaneously.

14. The method of claim 8 further comprising:

a plurality of tractor wheels;

wherein the at least one actuator assembly causes the plurality of tractor wheels to switch from traversing a first vertical plane of the well casing to a second vertical plane of the well casing when actuated.

15. A tractor wheel assembly for operational use in well casing of a wellbore, the tractor wheel assembly comprising:

at least one actuator assembly actionable coupleable to a tractor body; and at least one tractor wheel coupled to the at least one actuator assembly; wherein the at least one tractor wheel includes at least one bifurcated tract having a tooth comprising a leading and trailing edge for engaging the well casing; wherein the leading edge and trailing edge are separated by a dip; wherein the leading edge makes first contact with an adjacent surface in a first direction of wheel rotation; wherein the trailing edge makes first contact with an adjacent surface in a second direction of wheel rotation;

wherein the actuator assembly is actionable to shift the axis of rotation of the tractor wheel.

16. The tractor wheel assembly of claim 15 wherein there is at least one tractor wheel per actuator assembly.

17. The tractor wheel assembly of claim 15 wherein the at least one actuator assembly causes the at least one tractor wheel to switch from traversing a first vertical plane of the well casing to a second vertical plane of the well casing when actuated.

18. The tractor wheel assembly of claim 15 wherein the at least one actuator assembly in response to a first action causes the at least one tractor wheel to switch from traversing a first vertical plan of the well casing to a second vertical plane of the well casing and in response to a second action causes the at least one tractor wheel to switch from traversing the second vertical plane of the well casing to the first vertical plane.

19. The tractor wheel assembly of claim 15 further comprising:

a plurality of tractor wheels with at least one tractor wheel of the plurality is associated with a first group and at least one other tractor wheel is associated with a second group;

wherein the at least one actuator assembly causes the first group to switch from traversing a first vertical plane of the well casing to a second vertical plane of the well casing when actuated and the second group from traversing the second vertical plane of the well casing when actuated.

20. The tractor wheel assembly of claim 15 wherein the actuator assembly causes the switch simultaneously.

* * * * *